United States Patent [19]

Amorese

[11] Patent Number: 4,601,583

[45] Date of Patent: Jul. 22, 1986

[54] MULTI-HUBBED SEPARABLE BLADE AGITATORS

[75] Inventor: Franklyn J. Amorese, Hilton, N.Y.

[73] Assignee: Kennecott Corporation, Cleveland, Ohio

[21] Appl. No.: 695,321

[22] Filed: Jan. 28, 1985

[51] Int. Cl.[4] ..... B01F 7/22

[52] U.S. Cl. ..... 366/343; 366/325; 366/330; 416/241 R

[58] Field of Search ..... 366/343, 342, 279, 293, 366/330, 325, 241; 416/200 R, 230, 241 R

[56] References Cited

U.S. PATENT DOCUMENTS

| | | | |
|---|---|---|---|
| 2,811,339 | 10/1957 | Osborne | 416/200 |
| 3,494,708 | 2/1970 | Nunlist | 366/326 |
| 4,221,488 | 9/1980 | Nunlist | 366/343 |
| 4,264,215 | 4/1981 | Nunlist | 366/343 |
| 4,365,897 | 12/1982 | Amorese | 366/343 |

*Primary Examiner*—Robert W. Jenkins

*Attorney, Agent, or Firm*—R. Lawrence Sahr

[57] ABSTRACT

What is disclosed is a multi-hubbed, separable blade agitator assembly wherein the exterior surfaces of the hubs of each agitator blade as well as the exterior surface of the drive shaft are coated with glass and the hubs are interference fitted to the drivé shaft in glass-to-glass surface contact sufficient to withstand torque imparted to the agitator blades by the drive shaft.

13 Claims, 8 Drawing Figures

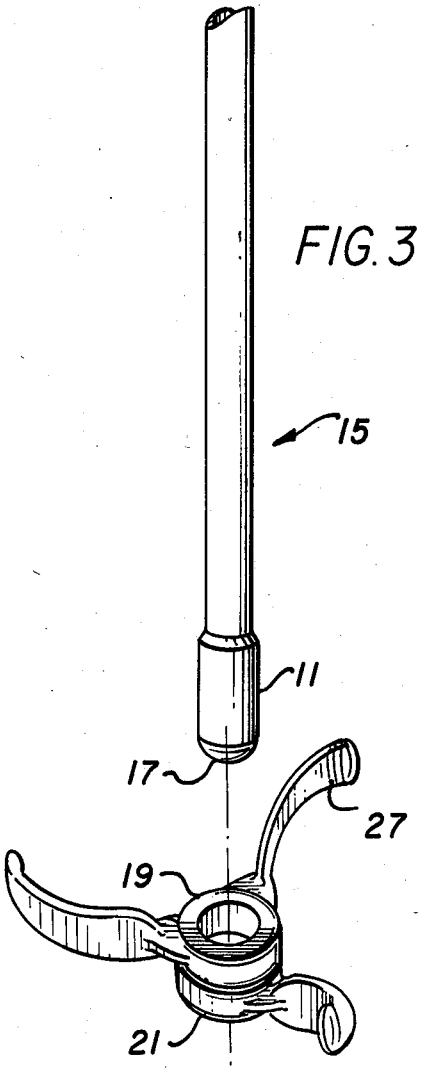
FIG. 3
FIG. 4a
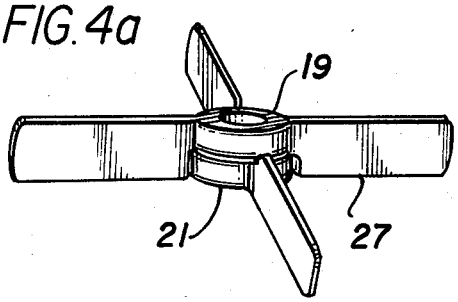
FIG. 4b
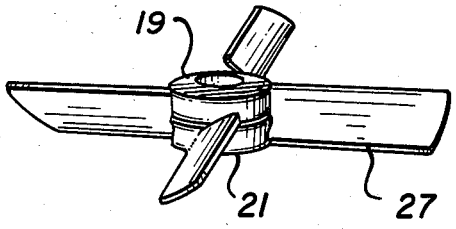
FIG. 4c
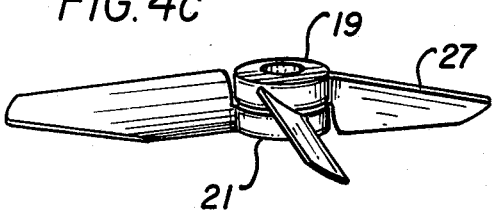

MULTI-HUBBED SEPARABLE BLADE AGITATORS

BACKGROUND OF THE INVENTION

1. Field of the Invention

The present invention relates generally to separable blade agitators and particularly to glass coated agitators for corrosive service and more particularly glass coated agitators which can be assembled and disassembled within confined areas and introduced and withdrawn from such confined areas through size limiting means of ingress and egress.

2. Background of the Prior Art

Separable blade agitators are well known in the art and are described, for example, in U.S. Pat. Nos. 2,811,339 and 3,494,708. Briefly, a separable blade agitator includes a drive shaft and a separable impeller. The impeller includes a hub for attachment to the drive shaft and two or more blades extending outwardly from the hub. The entire exterior surface of the assembly of the drive shaft, hub and blades exposed to the vessel contents is glass coated to resist corrosion, adherence and abrasion. Such separable blade agitators are used in vessels for mixing various corrosive, adhesive, abrasive or easily contaminated ingredients, such as acids, polymers, pharmaceuticals, dyes and the like.

These agitators especially have great value in closed vessels of this type because they eliminate the need for large vessel openings normally used for agitator removal and admittance. In this respect, the separable impeller portion can be passed into a pressure vessel through a relatively small manhole opening and assembled, within the vessel, to the drive shaft.

Separable blade agitators are useful in either closed or open vessels in that they permit replacement of damaged impellers or changing the size or type of impeller without the need to remove the entire agitator (i.e. drive shaft and impeller) from the vessel or to disconnect the drive shaft from the drive motor and seals.

The primary drawback of separable blade agitators of the above cited prior art is that relatively complicated, expensive components are needed to hold the shaft and agitator portion together in a fluid tight, gasketless connection which is able to transmit torque through the connection from the drive shaft to the impeller blades.

While separable blade agitators having gasketed connections are known, any gasket used must be made from tantalum or other exotic metal or from a fluorocarbon in order to resist the highly corrosive environments to which these gaskets may be exposed. Another drawback with gaskets is that they take a set due to repeated heating and cooling and eventually leak. Normally leaking gaskets can be sealed by retightening but this is difficult to do in separable blade agitators and often the leakage is not noticed until that leakage has reached the interior portions of the assembly, which are not glass coated, and has caused damage to the metal integrity.

Advances have been made in the field of separable blade agitators, to wit, as shown in U.S. Pat. No. 4,221,488 which completely eliminates the need for any gaskets or other assembly components and instead provides a separable blade agitator wherein the impeller is joined to the shaft in a glass-to-glass gasketless connection that is strong enough to transmit torque from the shaft to the agitator blade without the use of any key or spline connection. Thus, even if leakage does occur and corrosive liquids penetrate into the joint, no damage results because all surfaces coming in contact with the corrosive liquid are glass or enamel coated.

The separable blade agitator of U.S. Pat. No. 4,221,488 includes a hollow shaft which is closed at one end, the exterior surface of the shaft being provided with a corrosion resistant coating, such as glass or enamel. The separable impeller includes a hub with a bore therethrough and blades extending outwardly from the hub, the entire surface of the separable impeller, including the internal surface of the hub bore, being provided with a corrosion resistant glass or enamel coating.

The inside diameter of the bore and the outside diameter of the shaft, adapted to receive the impeller, are each machined to provide an interference fit of between 0.00025 and 0.00075 inches per inch of diameter. The assembly of the interference fit is accomplished preferably by super cooling the end of the shaft to shrink its diameter so that it may be inserted into the hub bore. Where three or more blades are desired, more than one impeller can be provided, each having a hub with one or more blades on that hub.

It had been assumed by those skilled in the art that, although there was a tolerance range for machining, grinding and honing the bores of the hubs, for interference fitting them onto the shafts, that where multiple hubs were fitted onto a single shaft, extreme care was required in the final honing to insure that both hubs had precisely the same bore sizes. This was viewed as especially important where the hubs were to be located in immediate proximity to each other. This was assumed because, in interference fitting, the upper limit of the outside diameter of the shaft would be dictated by the smallest diameter hub bore which was fitted over it. Thus, if an additional hub bore, added to the shaft, was larger in diameter, it would merely be relatively loose and would not be capable of bearing the same torque load as the hub that had the smaller diameter bore.

A possible solution to this problem was postulated applicable to a situation where a hollow or tube shaft was used. That postulation was to render the tube wall thin enough to permit sufficient flexibility of the wall so as to permit "necking", i.e., a slightly enlarged diameter of the tube outside diameter which would naturally occur at points on the tube not under the same amount of compressive force as that which was rendered to the tube shaft by the hub with the smallest bore diameter, due to the interference fit. However, this postulation and possible solution was abandoned in view of the fact that the tube is coated with glass, which is well known to be quite brittle. The "necking" was seen to be detrimental because it would tend to produce cracks in the glass, thus allowing corrosion, etc. to reach the underlying metal.

However, commercial considerations were such that the cost of producing sets of hubs with precisely matched bore sizes rendered the concept of multiple hubbed agitators with glassed surfaces, economically unfeasible. Thus, there was a need to be able to develop a system wherein commercial tolerance ranges could be applied to the honing of hub bores, yet still permitting such multiple hubs to be interference fitted to a shaft, both with glass coatings, such that the glass coatings did not crack and the interference fits on each of the hubs was adequate to permit the required torque loading. The market for replacement parts demands that a user be able to replace only one hub and blade assembly, when only one is needed, rather than having to purchase a matched set.

BRIEF SUMMARY OF THE INVENTION

It has been found surprisingly, that commercial honing tolerances range of 0.0004", applied to the glass surfaces of the agitator hub bore diameters, can be utilized in interference fitting multiple hubs to a single hollow shaft, provided that metallurgically correct steel is used for the hollow tube shaft and provided that certain grades of high silica glass are used for the glass coatings. It has, further, been found that slippage resistance on torque loading can be further enhanced by compressing the abutting faces of the multiple hubs together on mounting, the compression force only being released after full temperature equalization, of the agitator assembly following the interference fitting together of the agitator blade assemblies and the drive shaft.

These and other features of the present invention will be more completely disclosed and described in the following specification, the accompanying drawing and the appended claims.

BRIEF DESCRIPTION OF THE DRAWINGS

FIG. 3 illustrates by projection view an alternative hollow tube drive shaft shape exploded away from two agitator blade assemblies which include a total of three retreat curve agitator blades.

FIG. 4*a* illustrates by projection view an alternative arrangement of two agitator blade assemblies which include a total of four vertical turbine agitator blades.

FIG. 4*b* illustrates by projection view an alternative arrangement of two agitator blade assemblies which include a total of four pitched turbine agitator blades.

FIG. 4*c* illustrates by projection view an alternative arrangement of two agitator blade assemblies which include a total of three turbo-foil agitator blades.

DETAILED DESCRIPTION

Figure 1:
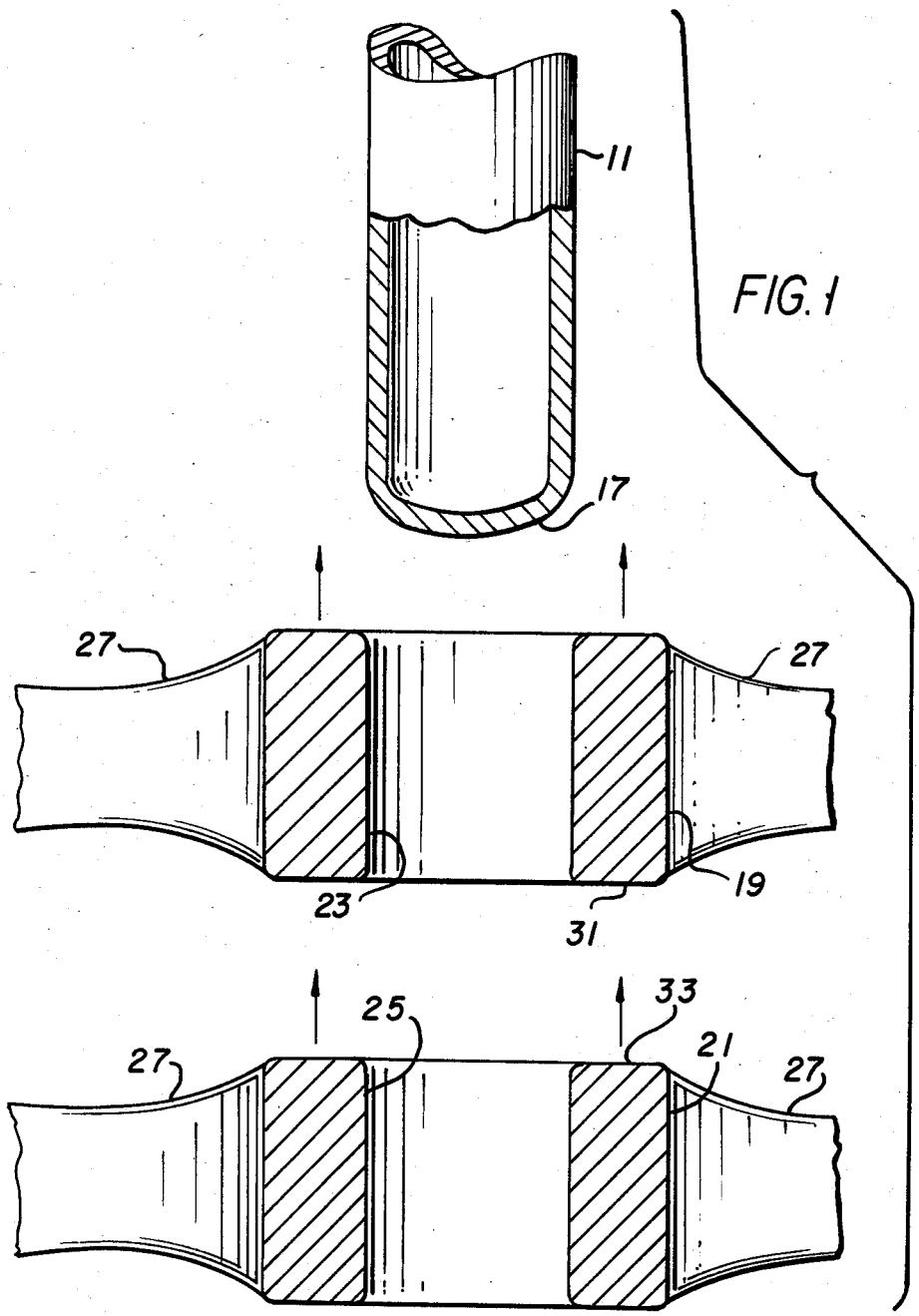
FIG. 1 is an exploded elevation view of the mating end of a hollow tube drive shaft and two hubs of agitator blade assemblies, with sections cut away.

Referring to FIG. 1, there is shown a section 11 of a hollow tube drive shaft 15. The particular section 11 of the drive shaft 15 which is shown in FIG. 1 is that section 11 which mates with other assemblies, the combination of which form an agitator assembly 13 which is shown in one arrangement in FIG. 5*b*. In FIG. 1, the section 13 has a closed end 17 which is formed, for example, by welding a cap or head of corresponding size to the hollow tube from which the drive shaft 15 is formed.

In the present invention, the section 11 of the drive shaft 15 as well as all other portions of the exterior surface of the drive shaft, which are exposed to operating conditions, are coated with glass, the glass being bonded to the drive shaft by conventional practice well known to those with skill in the art. Because the use of particular compositions of glass are important to the present invention, it has been found that not all metals are appropriate for use in the construction of the drive shaft 15. In particular it has been found that seamless mechanical steel tubing which conforms to ASTM-A-519 fulfills the requirements of the present invention, provided that the steel used is classified as low carbon steel, as is well understood by those with skill in the art. In particular, the steel must also be a grade of the AISI 1000 series steels, preferably grade AISI 1015. Various compositions classified as killed steel are acceptable. If the steel used for the drive shaft does not conform to the exact chemical composition requirements of the above mentioned steels, it has been found that the glass coating will not sufficiently adhere and bond to the surface thereof to withstand the stresses placed thereon by the present invention, nor will it form in a porosity free coating.

As is well known to those with skill in the art, it had been believed that it was necessary to machine both the exterior and interior surfaces of the commercially available tubing. The exterior was machined to produce a clean surface for optimum glass adherence. The interior was machined to ensure that it was concentric with the exterior because the wall thickness of such commercially available steel tubing varies as much as 10% or more. Specifically, it was known to those will skill in the art that variance in wall thickness will produce differentials in the actual expansion and contraction forces of the tube in direct proportion to the differentials in that wall thickness, when exposed to substantial temperature changes, thus promoting localized cracking of the glass adjacent to those points where wall thickness gradients occured.

In the present invention, surprisingly, there is no need to impose a special limitation of uniform wall thickness on the tubing used to make the drive shaft 15. It has been found that the tolerances inherent with the commercially available steel tubing applicable to the present invention are acceptable without any machining being performed to the interior thereof, provided the above mentioned specifications for that steel tubing are adhered to.

The thickness of the glass applied to the drive shaft 15 appears to be critical although it is not completely understood why. However, it has been found that to ensure the absence of glass cracking, the glass coating on the drive shaft, applicable to interference fitting, must be within a thickness range of 0.0390" to 0.0460", and preferably within a thickness range of 0.0402" to 0.0450". It has also been found that, for the present invention, it is necessary to finish machine the glass coating on the exterior of the drive shaft section 11, for example, by grinding and honing to a tolerance of ±0.0004" and preferably to a tolerance of ±0.0002".

Referring again to FIG. 1, there are shown two hubs 19 and 21 which are substantially greater in wall thickness than the tubing used in the drive shaft 15. This feature is necessary to ensure that most of the flex, caused by stresses which exist in the agitator assembly 13 after it is assembled, will occur in the drive shaft section 11 which is in contact with the hubs 19 and 21, rather than in the hubs 19 and 21 themselves. It has been found that, in the present invention, the use of hub wall thicknesses which are approximately equivalent to, or less than, the wall thickness of the drive shaft section 11, tends to promote cracking of adjacent glass coating.

The hubs 19 and 21, respectively, include bores 23 and 25 which are glass coated. The metal used to make the hubs 19 and 21 should have a coefficient of expansion and contraction which is generally equal to that of the drive shaft 15, although it is not necessary to use identically the same metallurgical compositions of metal. In other words, for example, it is acceptable to use any otherwise suitable grade of mild or low alloy steel for the hubs 19 and 21 provided that the coefficient of expansion and contraction of such steel is equivalent to that of the steel, specified above, which is used for the drive shaft 15. This is not to say that the steel used for the hubs 19 and 21 needs to have a coefficient of expansion and contraction which is precisely identical with to that of the steel used for the drive shaft 15. To the contrary, the coefficients of expansion and contraction merely need to be within the range of that which is considered equivalent to those with skill in the art. However, the metal used for both hubs 19 and 21 should be of identical grades. To enable adherence of the glass coating to the hubs, when steel hubs are to be used, the steel used should be titanium stabilized steel, the titanium content being approximately 4 times greater than the carbon content and the carbon should be within the range commonly referred to as low carbon by those with skill in the art.

The height (or length) of the bores 23 and 25 is required to be sufficient to permit substantial contact surface between the bores 23 and 25 and the mating surface of the drive shaft section 11. It has been found that a ratio of nominal bore height to nominal drive shaft diameter, at a design minimum, should be 1:1.75. For example, a drive shaft of 3½" diameter should only be assembled to hub bore heights of no less than 2" to produce what is considered an acceptable level of resistance to torque-produced slippage, the minimum permissible, for example, on a 3½" diameter drive shaft 15, is 15,000 inch/pounds including a substantial safetly factor.

Figure 5A:
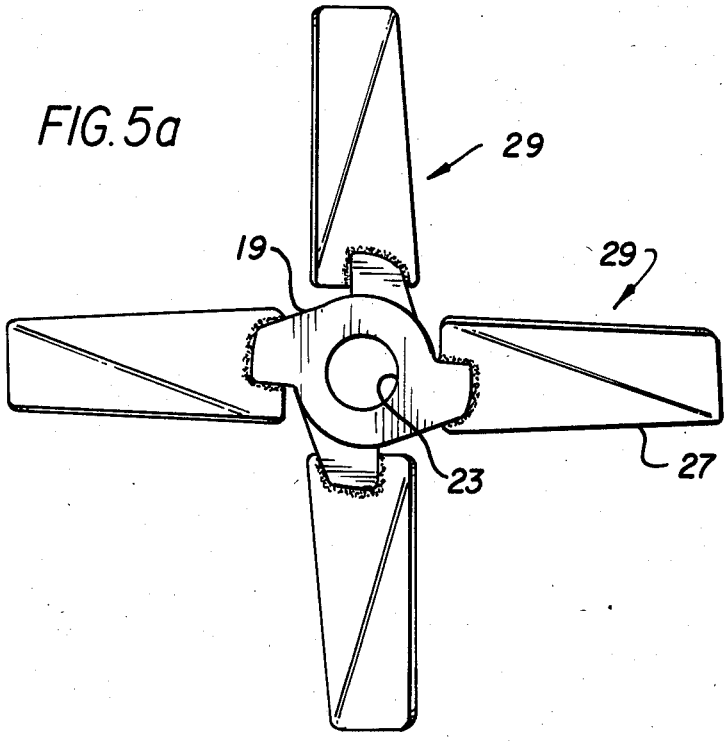
FIG. 5*a* illustrates by plan view an alternative arrangement of two agitator blade assemblies which include a total of four turbo-foil agitator blades.
Figure 5B:
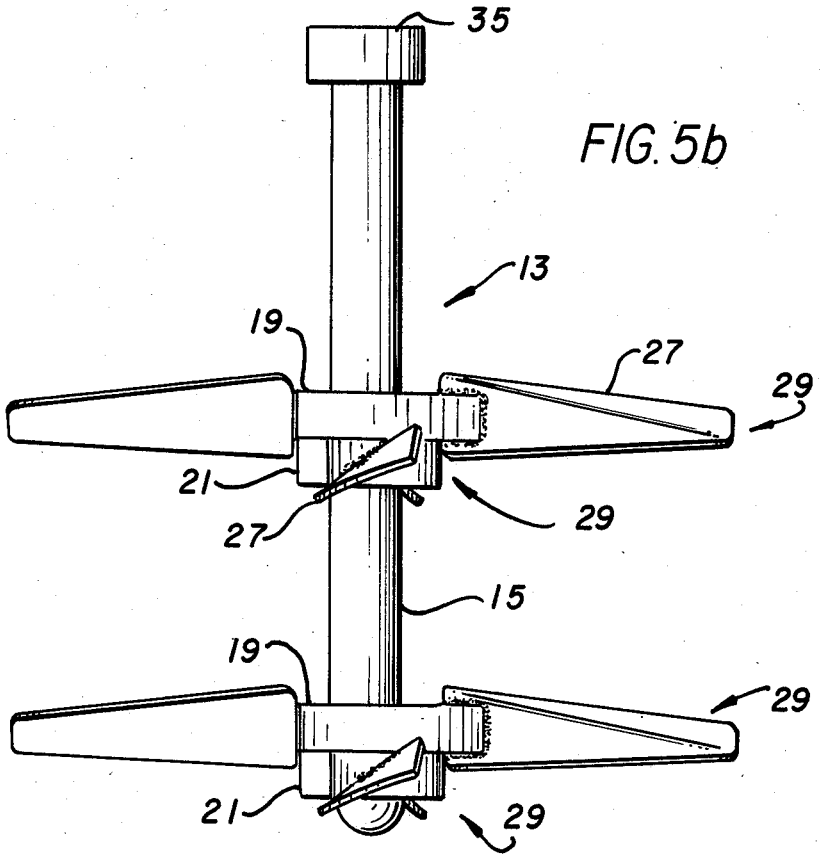
FIG. 5*b* illustrates by elevational view an agitator assembly wherein four agitator blade assemblies, as shown in FIG. 5*a*, are mounted onto a drive shaft.

Referring again to FIG. 1, attached to and radially extending from hubs 19 and 21 are agitator blades 27. A variety of arrangements and shapes for agitator blades 27 are illustrated in FIGS. 3, 4*a–c* and 5*a*, however, it is to be understood that alternative different arrangements and shapes are also included within the scope of the present invention although not specifically illustrated. The combination of the agitator blades 27 with a hub 19 or 21 produces an agitator blade assembly 29, a pair of which are best illustrated in FIGS. 5*a* and 5*b*.

The totality of each of the agitator blade assemblies 29 is also coated with glass of the same composition used to coat the drive shaft 15. In particular, it has been found that within the scope of the present invention, it is important to limit the thickness of the glass coating on the surface of the hub bores 23 and 25 to a range of 0.0400" to 0.0456" and, preferably to a range of 0.0412" to 0.0445". It has been found that the use of glass coatings on the hub bores 23 and 25 which have a thickness outside of the above specified ranges tend to promote either localized glass cracking or porosity in the glass.

Figure 2:
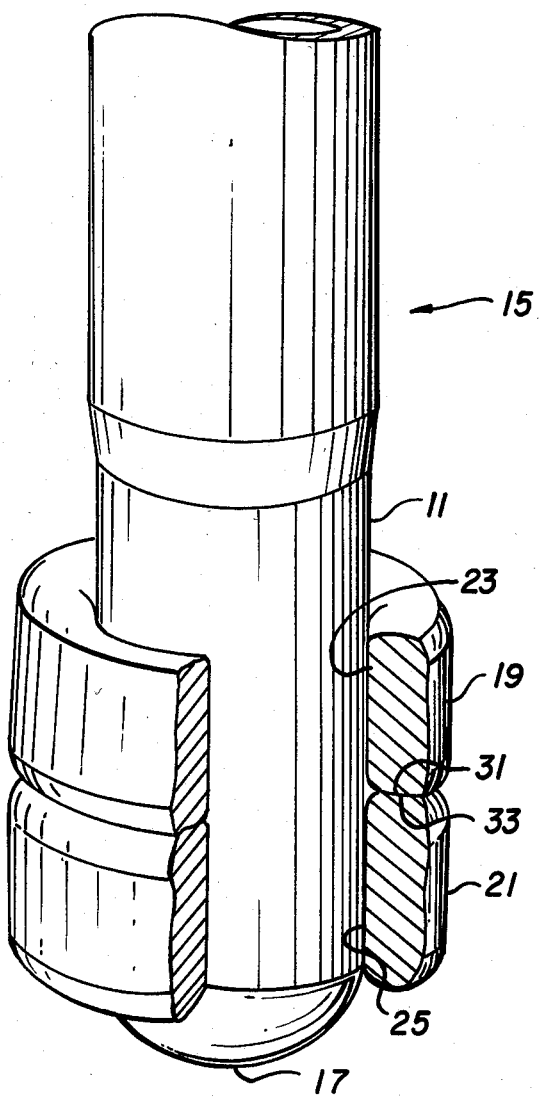
FIG. 2 is a projection view of the assembly of the mating end of a hollow tube drive shaft assembly to two hubs of agitator blade assemblies, partially cut away.

Referring to FIG. 2, there is shown an assembly of two hubs 19 and 21 mounted onto section 11 of the drive shaft 15 with an interference fit in accordance with the present invention. The two hubs 19 and 21 are assembled to the drive shaft in the same general manner as described in U.S. Pat. No. 4,221,488, however, with the provision that the adjacent faces 31 and 33, respectively, of hubs 19 and 21, should abut and be in substantial contact with each other upon assembly and held there is such position until all parts of the agitator assembly 13 have reached equal temperature, to avoid loss of face contact by elongation of the shaft which would occur as it was brought up to ambient temperature. It has been found that the substantial contact between the adjacent faces 31 and 33, respectively, of hubs 19 and 21 provides a significant element in enhancing the ability of the individual agitator blade assemblies 29 to resist torque-produced slippage in operation. This ability to resist torque-produced slippage is increased to an even greater degree when there is a mutual compression loading on the glassed surfaces of the adjacent faces 31 and 33. Such a compression loading is induced by the application of mechanical or hydraulic clamping of the two adjacent faces 31 and 33, of the agitator blade assemblies 29, together before assembly onto the drive shaft section 11. Again, in this case, the compression force applied is not released until, after assembly, all portions of the agitator assembly have equalized in temperature. Thus the interference fit between the drive shaft section 11 and the bores 23 and 25 of the hubs, respectively, 19 and 21, serves in and of itself to induce resistance to torque-induced slippage and maintains the contact, in the first case, between the adjacent faces 31 and 33 of the respective hubs 19 and 21 to produce friction there between and, thus, additional resistance to torque-induced slippage of each agitator blade assembly 29 in respect to the other, and in the second case, to maintain the mutual compressive forces applied by each hub 19 and 21 to the other across their respective adjacent faces 31 and 33 to increase the resistance to torque-induced slippage of each agitator blade assembly 29 in respect to the other. It should be noted that the foregoing is not limited to just agitator blade assemblies 29 in contact with each other. Rather, the present inventions can be applied to sets of two or more, for example where three, four, five or more agitator blade assemblies 29 were mounted together, in contact at their respective adjacent hub faces, on a single drive shaft 15 as will be well understood by those with skill in the art.

In respect to guidlines for interference fitting of the hubs 19 and 21 to the drive shaft section, the teaching of U.S. Pat. No. 4,221,488 may be referred to. However, the tolerance range between or among the glass coated bores 23 and 25 of the respective hubs 19 and 21 may vary up to ±0.0002", for a total range of 0.0004", after honing, without encountering any tendency for localized glass cracking noted. The mating adjacent faces 31 and 33 of the respective hubs 19 and 21 should be preferably perpendicular to the bores within a tolerance of ±0.0010, for a total range of 0.0020 for best results, however, it is also preferred that the mating adjacent faces do not have a finish which is finer than 10–20 RMS.

The glass used to coat the various above described elements of the present invention is classified as a high silica glass, containing greater than 60% $SiO_2$ and which also contains at least 10 additional oxides. Glass coatings of this type, applied to steels, are available in the applied state from The Pfaudler Company of Rochester, N.Y. marketed under the trademarks GLASTEEL or NUCERITE. Such glasses are applied in the conventional manner as is well familiar to those with skill in the art.

Referring to FIG. 5*b*, there is shown an agitator assembly 13 which includes four agitator blade assemblies 29 segregated into two pairs. Within the scope of the present invention, one pair could be eliminated or additional pairs could be added. The drive shaft 15 has mounted to its upper end, as shown in FIG. 5*b*, a coupler 35 which serves to connect the agitator assembly 13 to a rotary drive mechanism, not shown. The coupler 35 may also serve the purpose of holding the agitator assembly 13 suspended within a vessel, also not shown.

Although the present invention has been described herein with a certain degree of particularity it is understood that the present disclosure has been made only as an example of the preferred embodiment of that present invention and that the scope of the invention is defined by what is hereinafter claimed.

What is claimed is:

1. Agitator assembly comprising:

(a.) a hollow tube drive shaft with a closed end, coated with glass on the external surfaces thereof, said glass coating which is finished machined along the section of said drive shaft to which at least one agitator blade assembly is to be mounted to a tolerance of ±0.0004";

(b.) at least two agitator blade assemblies, coated with glass on the external surfaces thereof, interference fitted to said finished machine section of said drive shaft, the abutting faces of said at least two agitator blade assemblies being in substantial contact with each other, each of said agitator blade assemblies comprising:

(i) a hub with an internal bore with a bore height which is no less than 1" in diameter for each $1\frac{3}{4}$" of drive shaft diameter, said internal bore having a glass coating which is finish machined to a thickness range of 0.0400" to 0.0456", said glass coated internal bore of said hub which does not vary in size more than ±0.0002" in diameter from the size of any other glass coated internal hub bore of any other agitator blade assembly of said agitator assembly; and (ii) at least one blade projecting radially from said hub;

(iii) wherein each face of said hub which abuts and comes into substantial contact with a face of another hub is within ±0.0010" of being perpendicular to the axis of said internal bore; and (iv) wherein the wall thickness of each of said hubs is substantially greater than the wall thickness of said hollow tube drive shaft;

(c.) wherein said drive shaft is composed of metal and wherein each of said hubs is composed of the same grade of metal as each of said other hubs and wherein the coefficient of expansion and contraction of the drive shaft and each of said hubs is equivalent; and (d.) wherein said glass coating is composed of a glass material which contains at least 60% $SiO_2$ and at least ten additional oxides.

2. The invention of claim 1 wherein said abutment and substantial contact of said faces of said hubs includes compressive forces imparted by each of the other.

3. The invention of claim 1 wherein the interior surface of said hollow tube drive shaft is unmachined.

4. The invention of claim 1 wherein said hollow tube drive shaft is low carbon steel and said steel is killed steel.

5. The invention of claim 4 wherein each hub of each agitator blade assembly is stabilized steel within a titanium content about 4 times greater than the carbon content and the carbon is within the range of low carbon steel, and the grade of steel of each hub is the same grade of steel as each other hub.

6. The invention of claim 4 wherein said hollow tube drive shaft is seamless mechanical steel tubing wherein the wall thickness thereof is within a tolerance of ±10% therethrough.

7. The invention of claim 1 wherein said hollow tube drive shaft is a grade of steel selected from AISI series 1000 and which is within the range of low carbon steel.

8. The invention of claim 7 wherein each hub of each agitator blade assembly is stabilized steel within a titanium content about 4 times greater than the carbon content and the carbon is within the range of low carbon steel, and the grade of steel of each hub is the same grade of steel as each other hub.

9. The invention of claim 7 wherein said hollow tube drive shaft is seamless mechanical steel tubing wherein the wall thickness thereof is within a tolerance of ±10% therethrough.

10. The invention of claim 1 wherein the thickness of the glass coating on said internal bores of said hubs is within a range of 0.0412" to 0.0445".

11. The invention of claim 1 wherein said hollow tube drive shaft is AISI grade 1015 steel.

12. The invention of claim 11 wherein each hub of each agitator blade assembly is stabilized steel within a titanium content about 4 times greater than the carbon content and the carbon is within the range of low carbon steel, and the grade of steel of each hub is the same grade of steel as each other hub.

13. The invention of claim 11 wherein said hollow tube drive shaft is seamless mechanical steel tubing wherein the wall thickness thereof is within a tolerance of ±10% therethrough.

* * * * *